US009141026B2

(12) United States Patent
Morimoto et al.

(10) Patent No.: US 9,141,026 B2
(45) Date of Patent: Sep. 22, 2015

(54) DEVELOPING APPARATUS AND IMAGE FORMING APPARATUS

(71) Applicant: Sharp Kabushiki Kaisha, Osaka-shi, Osaka (JP)

(72) Inventors: Kiyofumi Morimoto, Osaka (JP); Takeshi Ohkawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/565,594

(22) Filed: Dec. 10, 2014

(65) Prior Publication Data

US 2015/0168865 A1 Jun. 18, 2015

(30) Foreign Application Priority Data

Dec. 18, 2013 (JP) ..... 2013-260890

(51) Int. Cl.
*G03G 15/09* (2006.01)
*G03G 15/08* (2006.01)

(52) U.S. Cl.
CPC ..... *G03G 15/0808* (2013.01)

(58) Field of Classification Search
CPC . G03G 15/09; G03G 15/0921; G03G 15/095; G03G 15/0808
USPC ..... 399/273–276
See application file for complete search history.

(56) References Cited

U.S. PATENT DOCUMENTS

2010/0080608 A1* 4/2010 Mukai ..... 399/104

FOREIGN PATENT DOCUMENTS

JP 08-202153 A 8/1996

* cited by examiner

*Primary Examiner* — David Bolduc
*Assistant Examiner* — Barnabas Fekete
(74) *Attorney, Agent, or Firm* — Keating & Bennett, LLP

(57) ABSTRACT

A developing apparatus including a layer thickness adjustment member configured to regulate a layer thickness of a two-component developer carried on a surface of a developing sleeve of a developing roller is disposed so that one end portion in a width direction faces the surface of the developing sleeve at a predetermined interval. At two end portions in a longitudinal direction of the layer thickness adjustment member, a notch open to the one end side in the width direction is provided. Since an amount of conveyance of the developer locally increases at two end portions of the developing sleeve by providing such a notch in the layer thickness adjustment member, density of an ear of a magnetic brush to be formed increases, and it is possible to exhibit the sufficient seal performance and prevent the toner from being scattered.

5 Claims, 2 Drawing Sheets

DEVELOPING APPARATUS AND IMAGE FORMING APPARATUS

BACKGROUND OF THE INVENTION

1. Field of the Invention

The present invention relates to a developing apparatus and more specifically to an image forming apparatus that develops an electrostatic latent image on a photoreceptor using a two-component developer including a toner and a carrier.

2. Description of the Related Art

An electrophotographic image forming apparatus that forms an image by an electrophotographic method has been used as an electrostatic copier, a laser beam printer or the like. The electrophotographic image forming apparatus is provided with a developing apparatus for developing an electrostatic latent image formed on an image carrier such as a photoreceptor. As the developing method, a two-component developing method that performs development using a two-component developer (hereinafter, also referred to simply as a developer) containing a toner and a carrier has been known.

In the known two-component developing method, the carrier and the toner are stirred and frictionally charged with one another, and thus, the toner is carried on the surface of the carrier. On a surface of a sleeve containing a magnet, the carrier carrying the toner is formed in a protruding shape called an ear, and a plurality of ears is gathered to form a magnetic brush. When the toner contained in the ears of the magnetic brush moves to the electrostatic latent image on the photoreceptor from the sleeve, the electrostatic latent image is developed.

In order to develop the electrostatic latent image, since there is a need to move the toner contained in the two-component developer stored in the developing apparatus to the photoreceptor as described above, the toner is scattered, the interior of the apparatus is contaminated, or the toner adheres to a portion in which the latent image is not formed, and thus, fog occurs.

In order to prevent scattering of the toner in the developing apparatus, in a developing apparatus disclosed in JP 8-202153 A, a magnetic regulation blade is formed such that an interval between both end portions becomes narrower than an interval in a longitudinal center portion corresponding to an image region.

As a method for preventing the toner scattering from the developing apparatus, there is a method of providing a magnetic member at a position facing both end portions of a developing roller, forming a magnetic brush of the developer between the developing roller and the magnetic member, and performing a seal by the magnetic brush.

Next, in the image forming apparatus, high image quality of an image to be formed is required, and in order to do that, there is a need to perform a thin layer development that further reduces an amount of the developer layer carried on the developing roller surface of the developing apparatus.

In the case of the thin layer development, since an amount of the developer of the developing roller surface is small, even if the magnetic brush for the seal is formed as described above, it is not possible to achieve sufficient seal performance. Also, in the thin layer development, since an interval between the regulation blade and the developing roller surface is small, as in the developing apparatus described in JP 8-202153 A, it is not possible to set the interval at both end portions to be narrower than the interval of the central portion.

SUMMARY OF THE INVENTION

Preferred embodiments of the present invention provide a developing apparatus and an image forming apparatus capable of exhibiting sufficient seal performance and preventing the scattering of the toner.

According to a preferred embodiment of the present invention, a developing apparatus that includes a developing roller which includes a cylindrical sleeve pivotally supported in a freely rotatable manner and a magnet roller including a plurality of magnetic poles fixedly disposed in the sleeve, carries a two-component developer containing a toner and a carrier on a surface of the sleeve, and conveys the developer to a developing region facing a photoreceptor including an electrostatic latent image; a supply roller configured to supply the two-component developer to the surface of the sleeve on an upstream side in a rotational direction of the sleeve from the developing region; and a layer thickness adjustment member configured to regulate a layer thickness of the two-component developer carried on the surface of the sleeve, the layer thickness adjustment member including a band-shaped member that extends parallel to or substantially parallel to a rotational axis of the sleeve and over a length equal to or substantially equal to an axial length of the sleeve, one end portion thereof in a width direction being disposed to face the surface of the sleeve at an interval, and rectangular or substantially rectangular notches open to one end portion side in the width direction being provided at both end portions in a longitudinal direction.

Furthermore, according to a preferred embodiment of the present invention, the notch is provided at a position corresponding to the surface portion of the sleeve facing a non-image forming portion of the photoreceptor on which an electrostatic latent image is not formed.

Furthermore, according to a preferred embodiment of the present invention, the developing apparatus further includes a magnetic seal member made of a magnetic material that is disposed to face the surface portion of the sleeve at an interval.

When an interval between the surface of the sleeve and the one end portion in the width direction of the layer thickness adjustment member is set to A (mm), a length in the width direction of the notch is set to B (mm), and an interval between the surface of the sleeve and the magnetic seal member is set to C (mm), relationships of $(A+B)/A \leq$ about 1.4 and $C/(A+B) \geq$ about 0.7 are satisfied.

Furthermore, according to another preferred embodiment of the present invention, an image forming apparatus includes the above-described developing apparatus.

According to various preferred embodiments of the present invention, the layer thickness adjustment member configured to regulate the layer thickness of the two-component developer carried on the surface of the sleeve of the developing roller is disposed so that one end portion in the width direction faces the surface of the sleeve at a predetermined interval, and the rectangular or substantially rectangular notches open to the one end side in the width direction are provided at two end portions in the longitudinal direction.

By providing the notches at two end portions in the longitudinal direction of the layer thickness adjustment member, since an amount of conveyance of the developer locally increases at two end portions of the sleeve, the density of the ear of the magnetic brush increases, and it is possible to exhibit the sufficient seal performance and prevent scattering of the toner.

Further, according to a preferred embodiment of the present invention, the notch is provided at the position corresponding to the surface portion of the sleeve facing the non-image forming portion of the photoreceptor. Since the portion in which the amount of conveyance of the developer increases is located at a position that does not affect the formed image, it is possible to prevent an occurrence of density unevenness.

Further, according to a preferred embodiment of the present invention, the apparatus further includes the magnetic seal member made of a magnetic material that faces the surface portion of the sleeve at a predetermined interval. Thus, since the magnetic brush having a high density of ear is located between the magnetic seal member and the sleeve, it is possible to further enhance the seal performance.

Further, according to a preferred embodiment of the present invention, when the interval between the surface of the sleeve and the one end portion in the width direction of the layer thickness adjustment member is set to A (mm), the length in the width direction of the notch is set to B (mm), and the interval between the surface of the sleeve and the magnetic seal member is set to C (mm), relationships of $(A+B)/A \leq$ about 1.4 and $C/(A+B) \geq$ about 0.7 preferably are satisfied.

By setting the relationship of $(A+B)/A \leq$ about 1.4, it is possible to prevent an occurrence of fog in the formed image, and by setting the relationship of $C/(A+B) \geq$ about 0.7, it is possible to prevent an occurrence of developer accumulation in the vicinity of the magnetic seal member.

Further, according to various preferred embodiments of the present invention, by including the above-described developing apparatus, it is possible to achieve an image forming apparatus that forms a high quality image by the thin layer development.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
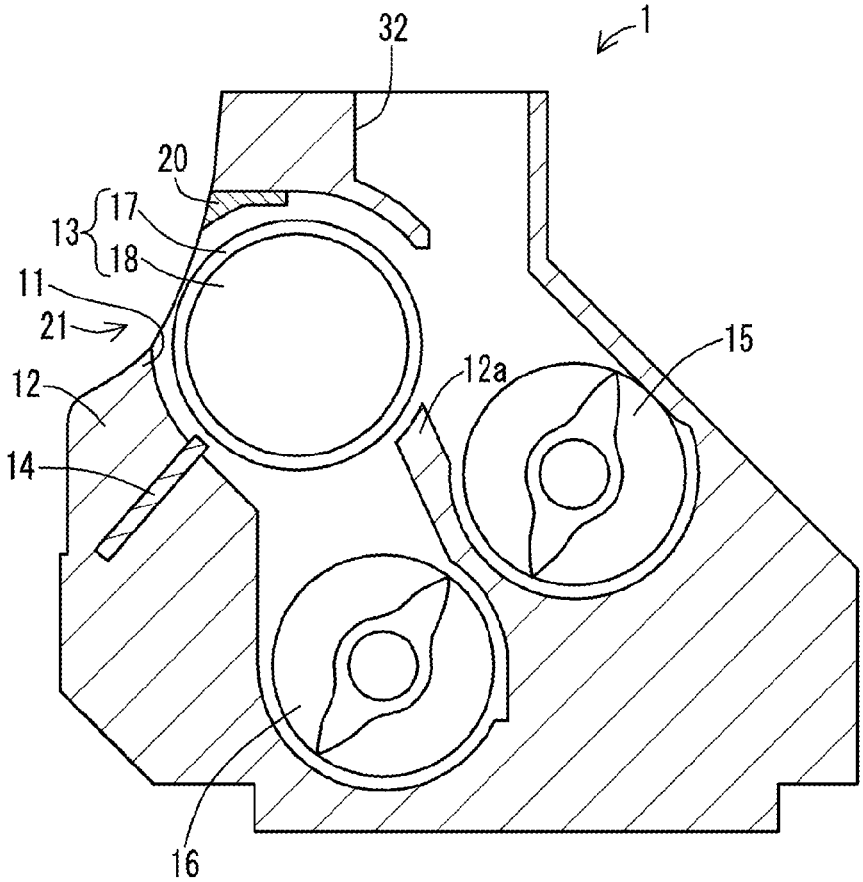
FIG. 1 is a cross-sectional view illustrating a simplified configuration of a developing apparatus 1 according to a preferred embodiment of the present invention.
Figure 2:
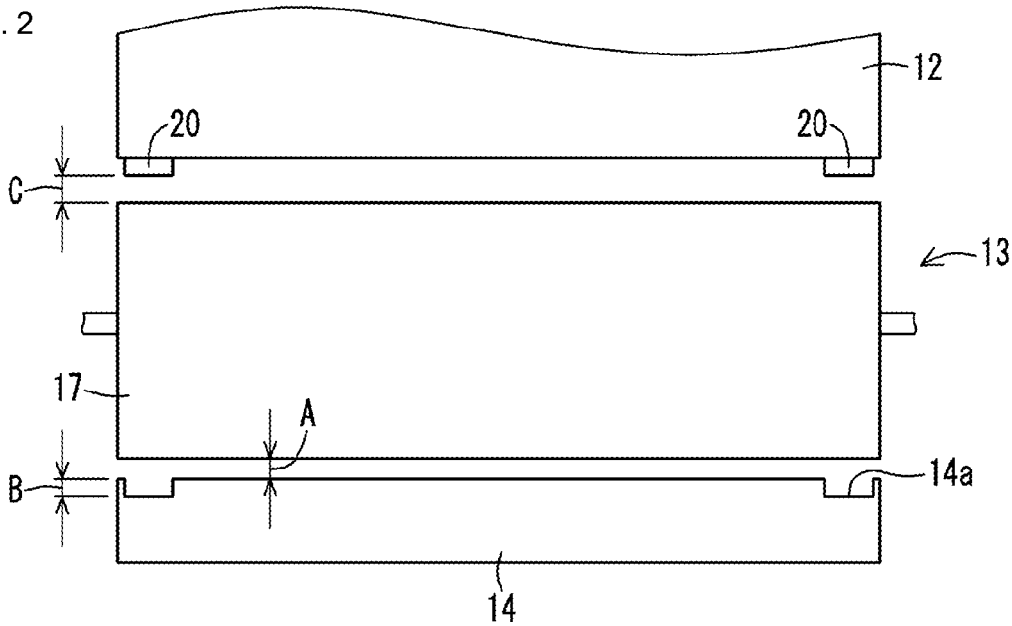
FIG. 2 is a schematic view illustrating a positional relationship between a developing roller 13, a layer thickness adjustment member 14, and a magnetic seal member 20.
Figure 3:
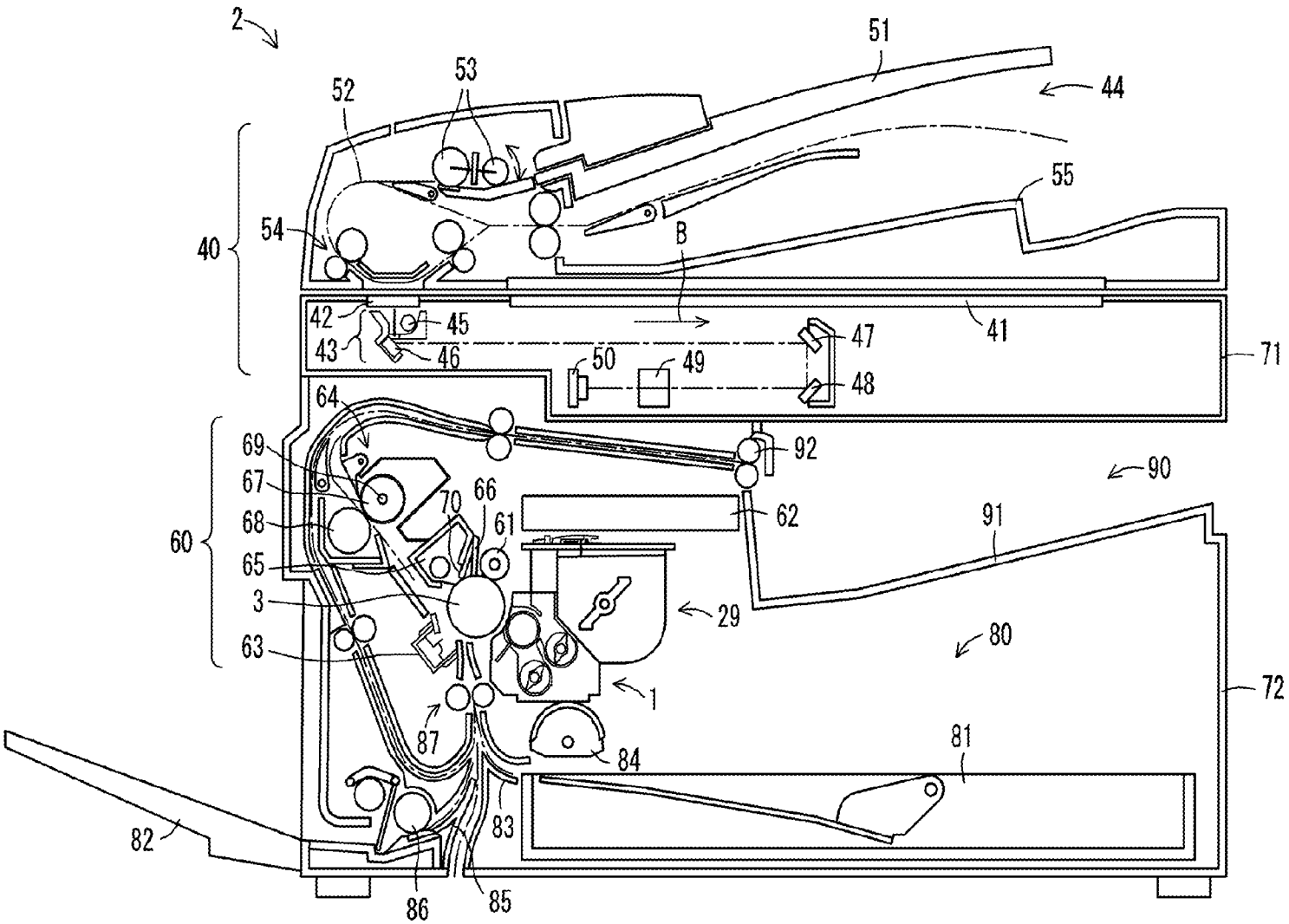
FIG. 3 is a cross-sectional view illustrating a simplified configuration of an image forming apparatus 2 including the developing apparatus 1 illustrated in FIG. 1.

FIG. 1 is a cross-sectional view illustrating a simplified configuration of a developing apparatus 1 according to a preferred embodiment of the present invention. FIG. 2 is a schematic view illustrating a positional relationship between a developing roller 13, a layer thickness adjustment member 14, and a magnetic seal member 20. FIG. 3 is a cross-sectional view illustrating a simplified configuration of an image forming apparatus 2 including the developing apparatus 1 illustrated in FIG. 1.

The developing apparatus 1 is preferably mounted, for example, on the image forming apparatus 2 illustrated in FIG. 3, and is used to form a toner image by developing an electrostatic latent image formed on an electrophotographic photoreceptor 3 serving as an image carrier (hereinafter, also referred to simply as "photoreceptor"). The developing apparatus 1 includes a developer container 12 which has an opening portion 11 that opens to face the photoreceptor 3 as the image carrier, for example, illustrated in FIG. 3, and in which a two-component developer containing a toner and a carrier (hereinafter, also referred to simply as "developer") is accommodated; a developing roller 13 serving as a developer supplier that is provided in the developer container 12 to face the photoreceptor 3 via an opening of the opening portion 11 of the developer container 12, and supplies the toner in the two-component developer to the photoreceptor 3; a layer thickness adjustment member 14 provided to face the developing roller 13; a first stirring and conveying member 15 that is configured to collect the developer remaining on the surface of the developing roller 13 after development, mixes and stirs the developer with the toner replenished from a toner hopper 29 to convey the developer and the toner; and a second stirring and conveying member 16 that is rotatably provided in the developer container 12, stirs and conveys the two-component developer in the developer container 12, and supplies the two-component developer to the developing roller 13. In this preferred embodiment, the developer is preferably a non-magnetic toner which includes a magnetic carrier, for example.

The developing roller 13 preferably includes a developing sleeve 17 that is rotatably and pivotally supported about an axis to face the photoreceptor 3 and that carries the two-component developer, and a magnet roller 18 that is fixed and contained in the developing sleeve 17 and that is configured to generate a magnetic field by a plurality of magnetic poles. In this preferred embodiment, the developing sleeve 17 is preferably rotationally driven in a clockwise direction toward a plane of FIG. 1 by a driving means (not illustrated). Electrical potential is supplied to the developing sleeve 17 from a power source (not illustrated) so that a potential difference occurs between the photoreceptor 3 and the developing sleeve 17.

The developing sleeve 17 preferably includes a hollow cylindrical shape in this preferred embodiment of the present invention. An outer diameter dimension of the developing sleeve 17 is preferably, for example, about 25 mm. The developing sleeve 17 is preferably made of a non-magnetic material such as, for example, aluminum, aluminum alloy, stainless steel, etc. As the aluminum alloy, for example, an aluminum (Al)-manganese (Mn)-based alloy or the like is adopted.

Specifically, the magnet roller 18 is preferably a member having a cylindrical or substantially cylindrical shape provided radially inside the developing sleeve 17, and is pivotally supported coaxially with the rotational axis of the developing sleeve 17. The magnet roller 18 is fixed in a non-rotatable manner, as is the developing sleeve 17.

The developing roller 13 magnetically adsorbs the carrier by the magnetic force of the magnet roller 18, and defines an ear of the developer called a "magnetic brush" including the carrier and the toner on the surface portion on the radially outer side as an outer circumferential surface portion of the developing sleeve 17. The magnetic brush extends along the magnetic field generated by the magnet roller 18. By rotating the developing sleeve 17, the developing roller 13 conveys the developer to a developing region 21 as a closest facing portion between the developing roller 13 and the photoreceptor 3.

The layer thickness adjustment member 14 is preferably a band-shaped member that is provided near the opening portion 11 of the developer container 12, regulates the layer thickness of the two-component developer carried on the surface of the developing sleeve 17, and extends to be parallel to or substantially parallel to the rotational axis of the developing sleeve 17 over at least the same length as the axial length of the developing sleeve 17. The layer thickness adjustment member 14 is disposed so that one end portion in the width direction, a free end portion, faces the surface of the developing sleeve 17 at a predetermined interval, and regulates the layer thickness of the two-component developer carried on the developing sleeve 17 by the interval.

The layer thickness adjustment member 14 is formed of a non-magnetic material or a magnetic material. As the non-magnetic material, for example, austenitic stainless steel such as SUS304 is preferably used. As the magnetic material, for example, nickel, ferritic stainless steel such as SUS430, and martensitic stainless steel such as SUS410S are preferably used. By forming the layer thickness adjustment member 14 from a non-magnetic material, magnetization is prevented, and it is possible to prevent the adhesion of the carrier to the layer thickness adjustment member 14. By forming the layer thickness adjustment member 14 from a magnetic material, since the layer thickness of the developer is regulated by cutting the ear formed by the magnetic field, an amount of the developer is small and is suitable for the thin layer development, and it is possible to reduce the stress applied to the developer during the layer thickness regulation and achieve a long life.

In the layer thickness adjustment member 14, rectangular or substantially rectangular notches 14*a* open to one end side in the width direction are provided at two end portions in the longitudinal direction. At the position provided with the notches 14*a*, the layer thickness of the two-component developer carried on the surface of the developing sleeve 17 is locally thick. In a portion in which the layer thickness of the two-component developer is thick, a carrying amount of the two-component developer increases, and the density of the ear formation of the magnetic brush increases.

The toner of the two-component developer carried on the surface of the developing sleeve 17 is scattered from the surface of the developing sleeve 17, due to rotation of the developing sleeve 17 or rubbing against the layer thickness adjustment member 14. It is possible to perform a seal using the magnetic brush by increasing the density of ear formation of the magnetic brush, in the two end portions in the axial direction of the developing sleeve 17 so that the scattered toner does not pass through the interval of the ear.

Also, a magnetic seal member 20 is preferably provided in the opening portion 11 of the developer container 12. The magnetic seal member 20 is located on an approximately opposite side of the layer thickness adjustment member 14 with the opening portion 11 interposed therebetween and is provided to correspond to two end portions in the axial direction of the developing sleeve 17. An interval between the opening portion 11 of the developer container 12 and the developing roller 13 appears in each of the top and bottom of the developing roller 13. One interval is preferably sealed by a magnetic brush in which the high density ear is formed due to the developer passed through the two end portions of the layer thickness adjustment member 14, and the other interval is preferably sealed by a magnetic brush in which the high density ear located between the magnetic seal member 20 and the developing sleeve 17 is formed.

For example, as the magnetic seal member 20, it is possible to use ferritic stainless steel and iron such as SUS430, single or composite ferromagnetic metal including nickel, cobalt or the like, magnetic resin or the like obtained by dispersing the ferromagnetic metals in resin.

The high density ears are preferably formed and sealed by the notches 14*a* of the layer thickness adjustment member 14 and the magnetic seal member 20, but it is preferred that the image formation remain unaffected by formation of the high density ears. In the two end portions in the axial direction of the portion in which the electrostatic latent image of the photoreceptor 3 is formed, when forming the high density ears, the developer density of that portion becomes higher than other portions, and even in the toner image developed on the surface of the photoreceptor 3, a portion becomes high density, and density unevenness occurs in the formed image.

In the photoreceptor 3, on the axially outer side of the image forming portion in which the electrostatic latent image is formed, a non-image forming portion in which an electrostatic latent image is not formed is preferably provided. In order to prevent an occurrence of density unevenness, it is preferred that the notches 14*a* and the magnetic seal member 20 be provided at positions corresponding to the surface portion of the developing sleeve 17 facing the non-image forming portion of the photoreceptor 3.

Thus, by setting a portion, in which the high density ears of the magnetic brush are formed, as a portion corresponding to the non-image forming portion, even when the developer concentration becomes locally higher, since a portion in which the image density of an image to be formed becomes higher does not occur, it is possible to prevent an occurrence of density unevenness.

The layer thickness adjustment member 14 is disposed so that an amount of conveyance of the developer carried on the surface portion of the developing sleeve 17 corresponding to the image forming portion of the photoreceptor 3 preferably is regulated to about 20 mg/cm$^2$ or more and about 80 mg/cm$^2$ or less, for example. A more preferable conveyance amount for thin layer development preferably is about 20 mg/cm$^2$ or more and about 55 mg/cm$^2$ or less, for example.

By setting the amount of conveyance of the developer to about 80 mg/cm$^2$ or less, a packing density of the magnetic brush in the image forming portion is prevented from becoming excessive in the developing region 21, and it is possible to prevent an increase in the dynamic frictional force due to the contact between the photoreceptor 3 and the magnetic brush at the developing region 21. Thus, since it is possible to bring the photoreceptor 3 and the magnetic brush in contact with each other through soft contact, it is possible to prevent an occurrence of sweep unevenness.

Furthermore, by setting the amount of conveyance of the developer to the developing region 21 to about 20 mg/cm$^2$ or higher, since it is also possible to prevent the packing density of the magnetic brush from becoming too small in the image forming portion of the developing region 21, it is possible to more reliably bring the photoreceptor 3 and the magnetic brush into contact with each other. This makes it possible to supply the toner in the magnetic brush to the photoreceptor 3.

In addition, as illustrated in FIG. 2, when an interval between the surface of the developing sleeve 17 and one end portion in the width direction of the layer thickness adjustment member 14 is set to A (mm), a length in the width direction of the notch 14*a* is set to B (mm), and an interval between the surface of the developing sleeve 17 and the magnetic seal member 20 is set to C (mm), it is preferred that relationships of $(A+B)/A \leq$ about 1.4 and $C/(A+B) \geq$ about 0.7 are satisfied.

An interval A (mm) is a gap that determines the layer thickness of the developer to be carried on the surface corresponding to the image forming portion of the developing sleeve 17 so as to control the conveyance amount in the above-described range, and preferably is, for example, about 0.5 mm$\leq A \leq$about 2.0 mm. The length B (mm) is a dimension by which a portion of the layer thickness adjustment member 14 is retracted by the notches 14*a* and the gap between the surface of the developing sleeve 17 and the layer thickness adjustment member 14 is widened, and preferably is, for example, 0 mm$<B \leq$about 1.0 mm. $(A+B)/A$ is an index that indicates how much the gap is wide in the seal portion compared to a gap of the layer thickness regulation, by providing the notches 14*a*. By setting the relationship of (A+B)/A≤about 1.4, for example, it is possible to prevent an occurrence of fog at the end portion of the image forming region due to the toner leakage.

The interval C (mm) is a gap between the magnetic seal member 20 and the developing sleeve 17, and is preferably about 0.5 mm≤C≤about 2.0 mm, for example. C/(A+B) indicates a ratio of the gap between the layer thickness adjustment member 14 and the developing sleeve 17 expanded by the notches 14*a* to the gap between the magnetic seal member 20 and the developing sleeve 17. It is possible to prevent an occurrence of the developer accumulation in the vicinity of the magnetic seal member 20 by satisfying the relationship of C/(A+B)≥Z about 0.7, for example.

The first stirring and conveying member 15 is preferably disposed on the downstream side in the rotational direction of the developing sleeve 17 from the developing region, collects the two-component developer peeled off from the surface of the developing sleeve 17 by a peeling pole of the magnet roller 18, and conveys the developer by mixing and stirring the developer with the toner supplied from a toner hopper 29. The first stirring and conveying member 15 is a collection conveying member that includes a first rotary shaft portion extending along the first axis parallel to or substantially parallel to the rotational axis of the developing sleeve 17, and a first spiral blade portion spirally attached to the first rotary shaft portion, and conveys the two-component developer in one direction along the first axis by the first spiral blade portion when the first rotary shaft portion rotates about the first axis.

The second stirring and conveying member 16 is preferably a developer supply member that is disposed vertically below the developing roller 13, stirs the two-component developer in the developer container 12, and supplies the two-component developer to the surface of the developing sleeve 17 on the upstream side in the rotational direction of the developing sleeve 17 from the developing region. The second stirring and conveying member 16 includes a second rotary shaft portion extending along an axis parallel to or substantially parallel to the rotational axis of the developing sleeve 17, and a second spiral blade portion spirally attached to the second rotary shaft portion. When the second shaft portion rotates about the second axis, the two-component developer is conveyed to the other direction along the second axis by the second spiral blade portion.

A positional relationship between the first stirring and conveying member 15 and the second stirring and conveying member 16 is preferably provided such that the first stirring and conveying member 15 is located on the upstream side in the rotational direction of the developing sleeve 17 from the second stirring and conveying member 16, and the first stirring and conveying member 15 is located above the second stirring and conveying member 16, in other words, the first rotary shaft portion of the first stirring and conveying member 15 is preferably disposed above the second rotary shaft portion of the second stirring and conveying member 16.

The conveying spaces of the first stirring and conveying member 15 and the second stirring and conveying member 16 communicate with each other, for example, at two ends in the conveying direction, respectively, and the two-component developer is conveyed while circulating between the first stirring and conveying member 15 and the second stirring and conveying member 16. The first stirring and conveying member 15 preferably stirs the two-component developer after development and the newly supplied toner while conveying the developer and the toner, and the sufficiently stirred two-component developer is conveyed by the second stirring and conveying member 16 and is supplied to the developing roller 13. Therefore, in order to prevent the two-component developer conveyed by the first stirring and conveying member 15 from being mixed in the second stirring and conveying member 16 before being conveyed to the end portion of the first stirring and conveying member 15, a partition wall 12*a* is provided between the first stirring and conveying member 15 and the second stirring and conveying member 16 and configured as a movement regulation member configured to regulate the movement of the two-component developer from the first stirring and conveying member 15 to the second stirring and conveying member 16. In this preferred embodiment, the partition wall 12*a* is defined by a portion of the developer container 12, and a leading end thereof comes close to the surface of the developing sleeve 17 to regulate the movement from the first stirring and conveying member 15 to the second stirring and conveying member 16.

For example, the magnet roller 18 preferably includes five magnetic poles of a developing main pole N1, a pumping pole N2, a peeling pole N3, a conveying pole S1, and a collection pole S2. The developing main pole N1, the pumping pole N2, and the peeling pole N3 are magnetic poles of N-pole, and the conveying pole S1 and the collection pole S2 are magnetic poles of S-pole. The five magnetic poles are arranged in the order of the developing main pole N1, the conveying pole S1, the pumping pole N2, the peeling pole N3, and the collection pole S2 toward the upstream side from the downstream side in the rotational direction of the developing sleeve 17. The developing main pole N1 is located at a position facing the photoreceptor 3. The conveying pole S1 is located on the upstream side in the rotational direction of the developing sleeve 17 rather than the developing main pole N1, at a position facing the layer thickness adjustment member 14. The pumping pole N2 is located at a position facing the first stirring and conveying member 15, pumps up the two-component developer carried by the first stirring and conveying member 15 by the magnetic force, and supplies the two-component developer from the first stirring and conveying member 15 to the surface of the developing sleeve 17.

The collection pole S2 holds the two-component developer remaining on the surface of the developing sleeve 17 after supply of the toner to the photoreceptor 3 up to the position of the peeling pole N3 facing the second stirring and conveying member 16, on the downstream side in the rotational direction of the developing sleeve 17 from the developing region.

The peeling pole N3 is disposed at a position facing the second stirring and conveying member 16 on the downstream side in the rotational direction of the developing sleeve 17 from the developing region, and peels the two-component developer remaining on the surface of the developing sleeve 17 after supply of the toner to the photoreceptor 3 from the surface of the developing sleeve 17 by the magnetic force.

Each magnetic pole of the magnet roller 18 in this preferred embodiment is preferably disposed, for example, in the circumferential direction of the developing sleeve 17 at a predetermined rotational angle from the developing main pole N1. Specifically, the conveying pole S1 is disposed at a position where the rotation angle from the developing main pole N1 is about 286°, for example. The pumping pole N2 is provided at a position where the rotation angle from the developing main pole N1 preferably is about 220°, for example. The peeling pole N3 is disposed at a position where the rotation angle from the developing main pole N1 preferably is about 140°, for example. The collection pole S2 is disposed at a position where the rotation angle from the developing main pole N1 preferably is about 80°, for example.

Furthermore, as an example of a magnitude (a maximum value of a normal component) of the magnetic flux density of each magnetic pole position, the magnitude of the magnetic flux density of the developing main pole N1 preferably is about 115 mT, the magnitude of the magnetic flux density of the pumping pole N2 preferably is about 63 mT, and the magnitude of the magnetic flux density of the peeling pole N3 preferably is about 42 mT. The magnitude of the magnetic flux density of the conveying pole S1 preferably is about 73 mT, and the magnitude of the magnetic flux density of the collection pole S2 preferably is about 83 mT.

Also, as illustrated in FIG. 3, the developing apparatus 1 is preferably provided with a toner hopper 29 configured to supply the toner to the developer container 12. The toner hopper 29 includes a hopper main body as a hollow container similar to the developer container 12. The hopper main body preferably includes a hopper side supply port portion including a hopper side supply port configured to supply the toner to the developer container 12. The developer container 12 is provided with a container side supply port portion 32 including a container side supply port. The space of the developer container 12 and the space of the toner hopper 29 communicate with each other via the container side supply port and the hopper side supply port.

The toner hopper 29 preferably supplies the toner in the hopper main body 30 into the developer container 12 via the hopper side supply port and the container side supply port. When the density of toner in the developer container 12 detected by a toner density sensor (not illustrated) becomes a predetermined reference value or less, the toner hopper 29 is controlled by a control unit (not illustrated) to supply the toner in the toner hopper 29 into the developer container 12.

According to the developing apparatus 1 illustrated in FIG. 1, an electrostatic latent image is preferably developed in the following manner. First, the developer in the developer container 12 is stirred and charged by the first and second stirring and conveying members 15 and 16, and is conveyed to a position facing the pumping pole N2 of the developing roller 13. The developer conveyed to a position facing the pumping pole N2 is magnetically adsorbed to the developing sleeve 17 by the magnetic force of the pumping pole N2, and forms a magnetic brush including the carrier and the toner on the outer circumferential surface portion of the developing sleeve 17.

The developer carried on the developing sleeve 17 as the magnetic brush is conveyed to the downstream side in the rotational direction of the developing sleeve 17 with the rotation of the developing sleeve 17, and an amount thereof carried on the outer circumferential surface portion of the developing sleeve 17 is adjusted at the position that faces the layer thickness adjustment member 14. Furthermore, the developer is frictionally charged by the layer thickness adjustment member 14.

The developer that has passed through the position facing the layer thickness adjustment member 14 is conveyed to the developing region 21 in which the developing main pole N1 is formed, with the rotation of the developing sleeve 17. In the developing region 21, by the potential difference between the developing sleeve 17 and the photoreceptor 3, only the toner is supplied to the photoreceptor 3 from the magnetic brush formed on the outer circumferential surface portion of the developing sleeve 17. As a result, the electrostatic latent image formed on the photoreceptor 3 is developed, and the toner image as a visible image is formed on the surface of the photoreceptor 3.

The developer remaining on the developing sleeve 17 without transition to the photoreceptor 3 preferably passes through the developing region 21, is conveyed into the developer container 12 by the magnetic force of the collection pole S2, is peeled off from the developing sleeve 17 by the peeling pole N3, and is released and recovered into the first stirring and conveying member 15. The recovered developer is conveyed while being stirred and mixed with the toner supplied from the toner hopper 29 by the first stirring and conveying member 15, and moves to the second stirring and conveying member 16 at the end portion in the conveying direction. The developer stirred and conveyed by the second stirring and conveying member 16 is used for development by being pumped by the pumping pole N2 again.

Also, it is preferred that the surface portion of the radially outer side as an outer circumferential surface portion of the developing sleeve 17 be roughened. The developing sleeve 17 is able to stably hold the developer by the surface roughening treatment. Thus, since it is possible to stably convey the developer to the developing region 21, the amount of the developer conveyed to the developing region 21 is maintained in an amount regulated by the layer thickness adjustment member 14, and it is possible to prevent an occurrence of unevenness in the amount of conveyance of the developer. Therefore, it is possible to prevent an occurrence of development unevenness.

As the surface roughening treatment, for example, a mechanical treatment such as sandblasting is preferably used. Although a ten-point average roughness Rz of the outer circumferential surface portion of the developing sleeve 17 is not particularly limited, it is preferably about 5 μm or more and about 12 μm or less in this preferred embodiment. The ten-point average roughness Rz is a value measured by using a surface roughness measuring instrument, Surfcorder SE-30H (trade name, manufactured by Kosaka Laboratory Ltd.) in accordance with Japanese Industrial Standards (JIS) B0601-1982, and by setting a measurement reference length to about 2.5 mm and an evaluation length to about 10 mm, for example. By setting the ten-point average roughness Rz of the outer circumferential surface portion of the developing sleeve 17 to about 12 μm or less, for example, since the adjustment of the developer amount using the layer thickness adjustment member 14 becomes easier, it is possible to set the amount of conveyance of the developer to a desired value. Also, by setting the ten-point average roughness Rz of the outer circumferential surface portion of the developing sleeve 17 to about 5 μm or more, for example, it is possible to stably convey the developer to the developing region 21.

Next, the toner and the carrier forming the two-component developer will be described. The toner used in the developing apparatus 1 according to a preferred embodiment of the present invention preferably contains a binder resin, a colorant, a wax, and a charge control agent.

The binder resin preferably includes a first polyester resin having a weight average molecular weight (Mw) of about 4000 to about 10000 (hereinafter, described as a "low molecular weight polyester resin"), and a second polyester resin having a weight average molecular weight (Mw) of about 50000 to about 300000 (hereinafter, described as a "high molecular weight polyester resin"), for example. When the binder resin includes the low molecular weight polyester resin, the low-temperature fixability of the toner is significantly improved. Moreover, when the binder resin includes the high molecular weight polyester resin, the high-temperature offset resistance and durability of the toner are significantly improved.

The high molecular weight polyester resin and the low molecular weight polyester resin are preferably obtained by, for example, polycondensing an alcohol component and a carboxylic acid component, which are raw material monomers, in the presence of a titanium-based catalyst.

As the alcohol component, a dihydric alcohol component and a trihydric or higher alcohol component are exemplified.

Examples of the dihydric alcohol component include alkylene oxide adducts of bisphenol A such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene(2.0)-2,2-bis(4-hydroxyphenyl) propane, and polyoxypropylene(6)-2,2-bis(4-hydroxyphenyl) propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and the like.

Examples of the trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene, and the like.

The acid component preferably includes, for example, a divalent carboxylic acid component, a trivalent or higher carboxylic acid component, and the like.

Examples of the divalent carboxylic acid component include, for example, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, anhydrides or lower alkyl esters of these acids, and the like.

Examples of the trivalent or higher carboxylic acid component include, for example, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetramethylenecarboxyl methane, 1,2,7,8-octanetetracarboxylic acid, pyromellitic acid, empole trimer acid, anhydrides or lower alkyl esters of these acids, and the like.

Among these, in particular, 1,2,4-benzenetricarboxylic acid, that is, trimellitic acid or a derivative thereof is preferably used because it is inexpensive and is easy to control reaction.

As described above, the weight average molecular weight (Mw) of the low molecular weight polyester resin is preferably about 4000 to about 10000, for example. When the weight average molecular weight of the low molecular weight polyester resin is less than about 4000, the storage stability of the toner is lowered. When the weight average molecular weight of the low molecular weight polyester resin is more than about 10000, the low-temperature fixability is lowered.

It is preferable that the low molecular weight polyester resin be a polyester resin including a linear main chain or a polyester resin having a structure including a linear main chain and a relatively short side chain bound thereto, and be a resin obtained by polycondensation of a divalent monomer component without using a trivalent or higher monomer component and a cross-linking agent.

The low molecular weight polyester resin does not contain a tetrahydrofuran (hereinafter, described as "THF") insoluble content and has the number average molecular weight (Mn) of about 4000 to about 10000, for example.

The ratio (Mw/Mn) of the weight average molecular weight to the number average molecular weight of the low molecular weight polyester resin is preferably from about 2 to about 10, for example.

The acid value of the low molecular weight polyester resin is preferably about 40 mgKOH/g or less and more preferably from about 10 mgKOH/g to about 30 mgKOH/g, for example. When the acid value of the low molecular weight polyester resin is more than about 40 mgKOH/g, there is a concern that the charging property of the toner is lowered in the high humidity environment.

The softening point of the low molecular weight polyester resin is preferably from about 80° C. to about 120° C. and more preferably from about 90° C. to about 110° C., for example. When the softening point of the low molecular weight polyester resin is lower than about 80° C., the cohesive force of the low molecular weight polyester resin is extremely lowered. When the softening point of the low molecular weight polyester resin is higher than about 120° C., the low-temperature fixability of the toner is lowered.

The glass transition temperature of the low molecular weight polyester resin is preferably from about 50° C. to about 75° C. and more preferably from about 50° C. to about 65° C., for example.

As described above, the weight average molecular weight (Mw) of the high molecular weight polyester resin is from about 50000 to about 300000 and preferably from about 150000 to about 250000, for example. When the weight average molecular weight of the high molecular weight polyester resin is less than about 50000, the durability and the high-temperature offset resistance of the toner are lowered. When the weight average molecular weight of the high molecular weight polyester resin is more than about 300000, the dispersibility of the wax in the binder resin is lowered.

It is preferable that the high molecular weight polyester resin be a polyester resin obtained by polycondensing a divalent monomer component and a trivalent or higher monomer component. Moreover, it is preferable that the high molecular weight polyester resin contain a cross-linked component. When the high molecular weight polyester resin contains a cross-linked component, the durability of the toner is significantly improved.

The high molecular weight polyester resin preferably has a THF insoluble content of less than about 3% by weight and the number average molecular weight (Mn) of about 6000 to about 12000 and preferably from about 8000 to about 10000, for example.

The ratio (Mw/Mn) of the weight average molecular weight to the number average molecular weight of the high molecular weight polyester resin preferably is about 30 or less and preferably from about 15 to about 25, for example. The Mw/Mn indicates the spread of the molecular weight distribution of the high molecular weight polyester resin. When the Mw/Mn is more than about 30, the high molecular weight polyester resin contains a low molecular weight component or a high molecular weight component. Therefore, the durability of the toner and the dispersibility of the wax are lowered.

The acid value of the high molecular weight polyester resin is preferably about 50 mgKOH/g or less and more preferably from 15 mgKOH/g to about 45 mgKOH/g, for example. When the acid value of the high molecular weight polyester resin is more than about 50 mgKOH/g, there is a concern that the charging property of the toner is lowered in the high humidity environment.

The softening point of the high molecular weight polyester resin is preferably about 110° C. to about 160° C. and more preferably about 120° C. to about 150° C., for example. When the softening point of the high molecular weight polyester resin is lower than about 110° C., the cohesive force of the resin is extremely lowered. When the softening point of the high molecular weight polyester resin is higher than about 160° C., the melt flowability and the low-temperature fixability of the toner using such a resin are lowered.

The glass transition temperature of the high molecular weight polyester resin is preferably about 50° C. to about 75° C. and more preferably about 55° C. to about 70° C., for example.

In this preferred embodiment, when the low molecular weight polyester resin and the high molecular weight polyester resin are polymerized, a titanium-based catalyst is used as a catalyst.

Examples of the titanium-based catalyst used in preferred embodiments of the present invention include at least one kind of titanium compounds including a titanium alkoxide compound which has an alkoxy group having 1 to 8 carbon atoms, aliphatic titanium carboxylic acid having 1 to 32 carbon atoms, aromatic titanium carboxylic acid having 7 to 38 carbon atoms, aliphatic titanyl carboxylic acid having 1 to 32 carbon atoms, aromatic titanyl carboxylic acid having 7 to 38 carbon atoms, titanyl carboxylic salt, and a titanium chelate compound.

Specifically, the above-described raw material monomers and the above-described titanium-based catalyst are added, the resultant mixture is subjected to reaction at a reaction temperature of about 170° C. to about 250° C. and a reaction pressure of about 5 mmHg to ordinary pressure (optimal temperature and pressure are determined depending on the reactivity of the monomer components), and the reaction may be terminated at the time point at which the above-described predetermined physical properties are obtained. Incidentally, the above-described raw material monomers may be further added at the time point at which the polycondensation reaction of the raw material monomers has been performed to some extent. Specifically, the raw material monomers may be further added after the raw material monomers are subjected to polycondensation at a temperature of about 220° C. to about 250° C. for about 3 to about 5 hours and cooled to a temperature of about 170 to about 210° C., for example.

Examples of preferred colorants include a colorant for yellow toner, a colorant for magenta toner, a colorant for cyan toner, a colorant for black toner, and the like. Hereinafter, a color index is abbreviated as "C. I.".

Examples of the preferred colorants for yellow toner include pigments such as C. I. Pigment Yellow 1, C. I. Pigment Yellow 5, C. I. Pigment Yellow 12, C. I. Pigment Yellow 15, C. I. Pigment Yellow 17, C. I. Pigment Yellow 180, C. I. Pigment Yellow 93, C. I. Pigment Yellow 74, and C. I. Pigment Yellow 185, inorganic pigments such as yellow iron oxide and ocher, nitro dyes such as C. I. Acid Yellow 1, oil-soluble dyes such as C. I. Solvent Yellow 2, C. I. Solvent Yellow 6, C. I. Solvent Yellow 14, C. I. Solvent Yellow 15, C. I. Solvent Yellow 19, and C. I. Solvent Yellow 21, and the like which are classified according to the color index.

Examples of the preferred colorants for magenta toner include C. I. Pigment Red 49, C. I. Pigment Red 57, C. I. Pigment Red 81, C. I. Pigment Red 122, C. I. Solvent Red 19, C. I. Solvent Red 49, C. I. Solvent Red 52, C. I. Basic Red 10, C. I. Disperse Red 15, and the like which are classified according to the color index.

Examples of the preferred colorants for cyan toner include C. I. Pigment Blue 15, C. I. Pigment Blue 16, C. I. Solvent Blue 55, C. I. Solvent Blue 70, C. I. Direct Blue 25, C. I. Direct Blue 86, and the like which are classified according to the color index.

Examples of the preferred colorants for black toner include carbon blacks such as channel black, roller black, disk black, gas furnace black, oil furnace black, thermal black, and acetylene black. An appropriate carbon black may be properly selected among these various carbon blacks depending upon design properties of the toner which is intended to be obtained.

Other than these pigments, vermilion pigments, green pigments, and the like can also be used. One kind of these colorants can be used alone, or two or more kinds thereof can be used in combination. In addition, colorants in the same color system can be used in combination of two or more kinds thereof, and one or two or more of each of colorants in different color systems can also be used. Moreover, even in the case of using colorants in the same color system, two or more kinds thereof can be used in combination. The content of the colorant in a melted and kneaded product of a toner raw material is, although not particularly limited, preferably about 0.1% to about 20% by weight and more preferably about 0.2% to about 10% by weight of the total amount of the melted and kneaded product, for example.

As a wax, any of, for example, hydrocarbon-based wax such as paraffin wax, polyethylene wax, polypropylene wax, polyethylene-polypropylene wax, and microcrystalline wax, alcohol-modified hydrocarbon wax, ester wax, carnauba wax, amide-based wax, and the like can be used. From the viewpoint of compatibility with the binder resin, releasibility, and a melting point, paraffin wax, ester wax, and microcrystalline wax are most preferable. One kind of the wax may be used alone, or two or more kinds thereof may be used in combination.

The melting point of the wax is preferably from about 50° C. to about 100° C. and more preferably from about 60° C. to about 90° C., for example, from the viewpoint of ensuring the low-temperature fixability of the toner. In the toner of various preferred embodiments of the present invention, since a low melting point wax having a low melting point as described above is uniformly dispersed in the binder resin including the low molecular weight polyester resin and the high molecular weight polyester resin, the low-temperature fixability is favorable.

The acid value of the wax is preferably less than about 2.0 mgKOH/g and more preferably less than about 1.0 mgKOH/g, for example. When the acid value of the wax is about 2.0 mgKOH/g or more, the compatibility with the binder resin is high and seepage at the time of fixing is deteriorated. Therefore, it is difficult to improve the low-temperature fixability of the toner.

The hydroxyl value of the wax is preferably less than about 5.0 mgKOH/g and more preferably less than about 3.0 mgKOH/g, for example. When the hydroxyl value of the wax is about 5.0 mgKOH/g or more, the compatibility with the binder resin is high and seepage at the time of fixing is deteriorated. Therefore, it is difficult to improve the low-temperature fixability of the toner.

The content of the wax is preferably from about 0.5 parts by weight to about 10 parts by weight and more preferably from 1 part by weight to about 8 parts by weight with respect to about 100 parts by weight of the binder resin, for example.

As a charge control agent, charge control agents for positive charge control and negative charge control which are used regularly in this field can be used.

Examples of the charge control agent for positive charge control include, for example, nigrosine dyes, basic dyes, quaternary ammonium salts, quaternary phosphonium salts, aminopyrine, pyrimidine compounds, polynuclear polyamino compounds, aminosilanes, nigrosine dyes and derivatives thereof, triphenylmethane derivatives, guanidine salts, amidine salts, and the like. Examples of the charge control agent for negative charge control include oil-soluble dyes such as, for example, Oil Black and Spilon Black, metal-containing azo compounds, azo complex dyes, naphthenic acid metallic salts, metallic compounds of benzilic acid derivatives (metal is boron, aluminum, or the like), metallic complexes and metallic salts of salicylic acid and derivatives thereof (metal is chrome, zinc, zirconium, or the like), fatty acid soaps, long-chain alkyl carboxylic acid salts, resin acid soaps, and the like. One kind of the charge control agents can be used alone, or two or more kinds thereof can be used in combination as necessary.

The content of the charge control agent in the melted and kneaded product of a toner raw material is not particularly limited, and can be properly selected from a wide range. However, the content of the charge control agent is preferably about 0.5 to about 5% by weight of the total amount of the melted and kneaded product, for example.

Other than the binder resin, the colorant, the wax, and the charge control agent, additives such as a conductive modifier, an extender, an antioxidizing agent, a flowability improving agent, and a cleaning improving agent may be properly contained in the toner according to various preferred embodiments of the present invention.

The toner of the present invention is produced by, for example, a melt-kneading method as described below.

The toner raw material is dry-mixed by a mixing machine and the obtained mixture is melted and kneaded by a kneading machine to obtain a melted and kneaded product. The melt-kneading is carried out while heating at a temperature equal to or substantially equal to higher than a melting temperature of the binder resin (generally about 80° C. to about 200° C. and preferably about 100 to about 150° C., for example).

It is preferable that the melted and kneaded product contain about 0.1% to about 20% by weight of the colorant, about 1% to about 10% by weight of the wax, and a balance of the binder resin, for example. Alternatively, it is preferable that the melted and kneaded product contain about 0.1% to about 20% by weight of the colorant, about 1% to about 10% by weight of the wax, about 0.5% to about 3% by weight of the charge control agent, and a balance of the binder resin, for example.

As the mixing machine, a commonly known mixing machine can be used. Examples thereof include, for example, Henschel type mixing apparatuses such as Henschel mixer (trade name, manufactured by Mitsui Mining Co., Ltd.), Super Mixer (trade name, manufactured by KAWATA MFG Co., Ltd.), and Mechanomill (trade name, manufactured by OKADA SEIKO CO., LTD.), Angmill (trade name, manufactured by Hosokawa Micron Corporation), Hybridization System (trade name, manufactured by Nara Machinery Co., Ltd.), Cosmosystem (trade name, manufactured by Kawasaki Heavy Industries, Ltd.), and the like.

As the kneading machine, a commonly known kneading machine can be used. Examples thereof include general kneading machines such as, for example, twin screw extruders, triple roll mills and laboplast mills. Furthermore, specific examples thereof include single-screw or twin-screw extruders such as TEM-100B (trade name, manufactured by Toshiba Machine Co., Ltd.) and PCM-65/87 (trade name, manufactured by Ikegai Corporation), and open roll type kneading machines such as Kneadex (trade name, manufactured by Mitsui Mining Co., Ltd.).

The melted and kneaded product is cooled and solidified to obtain a resin composition. The resin composition is pulverized into, for example, a coarsely pulverized product having a particle diameter of about 100 μm to about 5 mm by, for example, a hammer mill or a cutting mill. Thereafter, this coarsely pulverized product is further pulverized so as to obtain a fine powder product having a particle diameter of about 15 μm or less, for example. For pulverizing the coarsely pulverized product, for example, a jet type pulverizer that uses a supersonic jet stream, an impact type pulverizer that introduces the coarsely pulverized product into a space located between a rotator (rotor) which rotates at a high speed and a stator (liner) to perform pulverization, or the like can be used. In order to remove fine powder from the toner particles after pulverization by using a pulverizer, classification may be carried out.

The toner particles produced as described above may be used as a toner without any change, or those obtained by externally adding an external additive may be used as a toner. By externally adding an external additive, it is possible to obtain effects of powder flowability improvement, triboelectric charging property improvement, heat resistance, long-term storage stability improvement, cleanability improvement, and control of photoreceptor surface wearing characteristics.

Examples of the external additive include, for example, fine silica powder, fine titanium oxide powder, fine alumina powder, and the like. One kind of these external additives can be used alone or two or more kinds thereof can be used in combination.

The added amount of the external additive is preferably from, for example, about 0.1 parts by weight to about 2 parts by weight with respect to about 100 parts by weight of the toner particles, in consideration of the charging amount necessary for the toner, influence of abrasion on the photoreceptor due to the addition of the external additive, environmental characteristics of the toner, or the like.

As a carrier, a commonly known carrier can be used. Examples thereof include, for example, single or complex ferrite including iron, copper, zinc, nickel, cobalt, manganese and chromium; a resin coated carrier in which surfaces of carrier core particles are coated with a coating material; and a resin dispersion type carrier in which magnetic particles are dispersed in a resin.

As the coating material, a commonly known coating material can be used. Examples thereof include, for example, polytetrafluoroethylene, monochlorotrifluoroethylene polymers, polyvinylidene fluoride, silicone resins, polyester resins, metal compounds of di-tert-butylsalicylic acid, styrene resins, acrylic resins, polyamide, polyvinylbutyral, nigrosine, aminoacrylate resins, basic dyes, lakes of basic dyes, fine silica powder, fine alumina powder, and the like. Further, a resin to be used for the resin dispersion type carrier is not particularly limited, and examples thereof include styrene acrylic resins, polyester resins, fluorine resins, phenol resins, and the like. It is preferable that these resins be selected according to the toner components. One kind of these resins can be used alone, or two or more kinds thereof can be used in combination.

It is preferred that the shape of the carrier be a spherical shape or a flat shape. Although a volume average particle size of the carrier is not particularly limited, in consideration of high image quality, it is preferably about 10 to about 100 μm and more preferably about 20 to about 50 μm, for example. Further, the volume resistivity of the carrier is preferably about $10^8$ Ω·cm or more and more preferably about $10^{12}$ Ω·cm or more, for example.

The volume resistivity of the carrier is a value obtained from the current value after putting and tapping the carrier particles in a container having a cross-sectional area of about 0.50 $cm^2$ when a load of about 1 $kg/cm^2$ is applied to the particles filled in the container and voltage in which electric field of about 1000 V/cm occurs is applied between the load and the bottom electrode, for example. If the resistivity is low, the carrier is charged in the case of applying a bias voltage to the developing sleeve, and the carrier particles easily adhere to the photoreceptor. Furthermore, breakdown of the bias voltage easily occurs. It is preferred that the saturation magnetization of the carrier be about 40 emu/g or more and about 80 emu/g or less, for example.

The use ratio between the toner and the carrier in the two-component developer is not particularly limited and can be appropriately selected depending on the type of the toner and the carrier. For example, when mixing with the resin-coated carrier (density of about 5 to about 8 $g/cm^2$), the toner may be contained in amount of about 2% to about 30% by weight of the total amount of the developer, and preferably, in amount of about 2% to about 20% by weight, for example. In addition, a coverage ratio of the carrier by the toner is preferably about 40 to about 80%, for example.

Next, the image forming apparatus 2 including the developing apparatus 1 will be described.

As illustrated in FIG. 3, the image forming apparatus 2 is configured to generally include an original document reader (hereinafter, also referred to as a "scanner") 40, an image former 60, a sheet feeder 80, and a sheet discharger 90. The original document reader 40 is disposed vertically above the sheet feeder 80, and the sheet discharger 90 is disposed in an intermediate portion between the original document reader 40 and the sheet feeder 80 in the vertical direction. Specifically, the original document reader 40 is provided over the interior of the upper housing 71 and the upper portion of the upper housing 71, the sheet feeder 80 is provided below the lower housing 72, and the sheet discharger 90 is provided above the lower housing 72.

The original document reader 40 preferably includes a first platen glass 41 on which the original document is mounted, a second platen glass 42 to which the original document is fed from an original document feeder 44, a copy lamp 43 that reads the image information from the original document mounted on the first platen glass 41 or the original document fed to the second platen glass 42, and outputs the obtained image information to an image processor (not illustrated), and the original document feeder 44 that feeds the original document to the second platen glass 42. The copy lamp 43 is provided inside the upper housing 71. Furthermore, the original document feeder 44 is provided above the upper housing 71.

The copy lamp 43 preferably includes a copy lamp 45 defining and serving as a light source that irradiates light to the original document mounted on the first platen glass 41 or the original document fed to the second platen glass 42, a first mirror 46 that polarizes the reflected light image from the original document in a predetermined direction, second and third mirrors 47 and 48 that sequentially polarize the reflected light image from the original document polarized by the first mirror 46 in a further predetermined direction, an optical lens 49 that reduces the reflected light image from the original document deflected by the third mirror 48 and images the reflected light image on a photoelectric conversion element (Charge Coupled Device; abbreviated as CCD) 50, and the CCD 50 that photoelectrically converts the reflected light image from the original document imaged by the optical lens 49 and outputs the reflected light image to the image processing unit as an electrical signal.

The original document feeder 44 preferably includes an original document tray 51 on which the original document is mounted, a sheet feeding roller 53 that feeds the original document mounted on the original document tray 51 to the conveying path 52, a resist roller 54 that temporarily holds the original document fed by the sheet feeding roller 53 and feeds the original document to the second platen glass 42 by measuring the timing, and an original document discharging tray 55 to which the original document after reading the image information is discharged.

The image former 60 preferably includes a photoreceptor 3 defining and serving as an image carrier provided to be rotatable about an axis, a charger 61 defining and serving as a charging device, a laser scanner 62 defining and serving as an exposure device, the above-described developing apparatus 1 illustrated in FIG. 1 defining and serving as a developing device, a transferor 63 defining and serving as a transfer device, a fixing device 64 defining and serving as a fixing member, a cleaner 65 defining and serving as a cleaning device, and a neutralization device 66 defining and serving as a neutralization member. The charger 61, the laser scanner 62, the developing apparatus 1, the transfer unit 63, the cleaning unit 65, and the neutralization device 66 are preferably disposed around the photoreceptor 3 in this order toward the downstream side from the upstream side in the rotational direction of the photoreceptor 3. The photoreceptor 3 preferably has a columnar shape in this preferred embodiment. The shape of the photoreceptor 3 is not limited to a columnar shape and may be any other shape such as, for example, a cylindrical shape.

The developing sleeve 17 of the developing apparatus 1 is provided to be rotatable about an axis parallel to or substantially parallel to the rotational axis of the photoreceptor 3 to face the photoreceptor 3. Although an interval D2 between the developing sleeve 17 and the photoreceptor 3 is not particularly limited, it is about 0.25 mm or more and about 0.50 mm or less, for example, in this preferred embodiment. As mentioned above, the developing apparatus 1 develops the electrostatic latent image formed on the outer circumferential surface portion of the photoreceptor 3 by the exposure.

The charger 61 is configured to charge the outer circumferential surface portion of the photoreceptor 3. The laser scanner 62 exposes the charged photoreceptor 3. The transferor 63 is configured to transfer the toner image as a visible image formed by the development to the recording sheet as a recording medium. The transferor 63 is provided, for example, by a corona charger. The fixing device 64 is configured to fix the transferred toner image to the recording sheet. Specifically, the fixing device 64 preferably includes a heating roller 67 including a heating heater 69 inside, and a pressure roller 68 that elastically abuts against the surface portion of the heating roller 67. The cleaner 65 preferably includes a cleaning blade 70, and removes the toner remaining on the outer circumferential surface portion of the photoreceptor 3 after the transfer operation using the transferor 63 by scraping the toner with the cleaning blade 70, thus cleaning the outer circumferential surface portion of the photoreceptor 3. The neutralization device 66 neutralizes the outer circumferential surface portion of the photoreceptor 3 after cleaning performed by the cleaner 65.

The sheet feeder 80 preferably includes a sheet feeding cassette 81 which is provided inside the lower housing 72 and in which the recording sheet as a recording medium is accommodated, a manual feed tray 82 which is provided to protrude from a side surface portion of the lower housing 72 and on which the recording sheet is mounted, a first sheet feeding roller 84 that is configured to feed the recording sheet accommodated in the sheet feeding cassette 81 to the first conveying path 83, a second sheet feeding roller 86 that is configured to feed the recording sheet mounted on the manual feed tray 82 to the second conveying path 85, and a resist roller 87 that is configured to temporarily hold the recording sheet and feeds it to the image former 60 by measuring the timing.

The sheet discharger 90 preferably includes a sheet discharging roller 92 that discharges the recording sheet, on which the toner image is fixed by the fixing device 64 of the image former 60, to a sheet discharging tray 91, and the sheet discharging tray 91 that accommodates the recording sheet discharged by the sheet discharging roller 92.

The image forming apparatus 2 preferably includes a copying mode (hereinafter, also referred to as "copier mode"), a printer mode, and a facsimile mode, as an image formation (hereinafter, also referred to as "printing") mode. The corresponding print mode from the above-described print mode is selected by a controller (not illustrated) described later, depending on an operation input from an operator (not illustrated), and reception of a print job from an external host device such as a personal computer.

In the case of the copier mode of the above-mentioned print mode, an image is formed as follows. When the user mounts the original document on the first platen glass 41 of the original document reader 40, supplies the recording sheet to the sheet feeding cassette 81 or the manual feed tray 82 of the sheet feeder 80, inputs the number of prints, the printing magnification or the like by a condition input key of an operation panel (not illustrated) disposed on the front side toward the sheet of FIG. 3 of the upper housing 71, and then, operates a start key of the operation panel, a copying (copy) operation is initiated.

When the start key is operated, a main drive motor (not illustrated) preferably starts, and each drive gear (not illustrated) rotates. Next, the first sheet feeding roller 84 or the second sheet feeding roller 86 of the sheet feeder 80 rotates, the recording sheet is sent (fed) to the first conveying path 83 or the second conveying path 85, reaches a pair of resist rollers 87, and is captured by the resist rollers. By the resist rollers 87, the recording sheet is temporarily stopped to synchronize a timing at which a leading end portion of the toner image formed on the surface of the photoreceptor 3, i.e., an image formation start portion reaches the position provided with the transferor 63, and a timing at which an image formation-scheduled region of the recording sheet reaches the position provided with the transferor 63. At this time, the leading end portion of the recording sheet is preferably uniformly pressed against the resist roller 31, and thus, the correction of the leading end position of the recording sheet is performed.

Furthermore, in the original document reader 40, the copy lamp 45 is lighted, the copy lamp 43 starts to move in a direction of an arrow B, and thus, the exposure to the original document is initiated. The irradiation light irradiated to the original document from the copy lamp 45 is reflected by the original document to become the reflected light including the image information of the original document. The reflected light from the original document is input to the CCD 50 via the first mirror 46, the second mirror 47, the third mirror 48, and the optical lens 49. The image information of the original image is thus read.

The image information of the original document read as an optical signal in this manner is converted into an electrical signal by a CCD circuit (not illustrated) in the CCD 50, and is output to the image processing unit. In the image processing unit, image processing is performed under the conditions that are set for the input image information, and the image information subjected to the image processing is transmitted to the laser scanner 62 of the image former 60 as the print data.

Furthermore, in the image former 60, a portion of the outer circumferential surface portion of the photoreceptor 3 is charged to a predetermined potential over the entire axial direction of the photoreceptor 3 by the charging unit 61, and the entire outer circumferential surface portion of the photoreceptor 3 is charged to a predetermined potential by rotation of the photoreceptor 3. The outer circumferential surface portion of the charged photoreceptor 3 sequentially moves to the next step by the rotation of the photoreceptor 3.

In the laser scanner 62, although it is not illustrated, the laser beam emitted from the semiconductor laser is preferably irradiated to the photoreceptor 3 by a polygon mirror (rotating polygon mirror) including a plurality of reflecting surfaces in the rotational direction and various optical systems, while being deflected in accordance with the print data that is input from the image processor. As a result, the laser beam is scanned on the outer circumferential surface portion of the photoreceptor 3 charged by the charger 61, and an electrostatic latent image is formed on the outer circumferential surface portion of the photoreceptor 3.

Thereafter, the toner in the developer accommodated in the developer container 12 is supplied to the outer circumferential surface portion of the rotating photoreceptor 3 by the developing roller 13 in the developer container 12 of the developing apparatus 1. The toner adheres to the outer circumferential surface portion of the photoreceptor 3 in accordance to a potential gap that forms an electrostatic latent image. Thus, the electrostatic latent image is visualized (developed) to form a toner image.

Furthermore, the timing is measured by the resist roller 87 of the sheet feeder 80, and an image recording sheet including an image is fed to a transfer position between the photoreceptor 3 and the transfer unit 63. At the transfer position, the toner image formed on the outer circumferential surface portion of the photoreceptor 3 is transferred to the recording sheet by the transfer unit 63.

The recording sheet, onto which the toner image is transferred, is preferably conveyed to the fixing device 64, and heat and pressure are applied to the recording sheet when passing between the heating roller 67 and the pressure roller 68 of the fixing device 64. Thus, the unfixed toner of the surface portion of the recording sheet is melted to adhere to the recording sheet and is fixed thereto. The recording sheet, on which the toner image is fixed, is discharged to the sheet discharging tray 91 by the sheet discharging roller 92 of the sheet discharger 90.

Moreover, the toner remaining on the outer circumferential surface portion of the photoreceptor 3 without being transferred to the recording sheet is scraped off by the cleaning blade 70 of the cleaner 65, and is collected. The outer circumferential surface portion of the photoreceptor 3, from which the residual toner is scraped off by the cleaning blade 70, is neutralized by the neutralization device 66 in the course of moving to a position at which the charging unit 61 is disposed. If there is no need for neutralization, the outer circumferential surface portion of the photoreceptor 3 may not be neutralized by the neutralization device 66.

In the above-described preferred embodiment, although the original document is preferably mounted on the first platen glass 41 by the user to read the image information in a stopped state, the image information may be read in the state of being fed to the second platen glass 42 by the original document feeder 44. In this case, the original document is mounted on the original document tray 51 of the original document reader 40.

In this way, when the start key is operated in a case where the original document mounted on the original document tray 51 of the original document reader 40 is detected by a sensor (not illustrated), the sheet feeding roller 53 of the original document feeder 44 rotates, and the original document mounted on the original document tray 51 is fed to the conveying path 52. After the original document fed to the conveying path 52 is captured by the resist roller 54 provided in the conveying path 52 to perform positioning of the leading end of the original document, the original document is conveyed to a position, at which the second platen glass 42 is provided, as an original document reading position at a predetermined timing. The copy lamp 43 exposes the original document during conveyance, while stopping at a predetermined stop position as the original document reading position. The reflected light from the original document obtained by the exposure is read as the original document image as described above. In this way, the original document, from which the image information is read, is discharged to the original document discharging tray 55.

In the case of the above-described printer mode, the original document reader 40 is not operated, an image is formed in accordance with the image information that is input from an external host device such as a personal computer. Furthermore, in the case of the facsimile mode, the image is formed in accordance with the image information that is input via a communication line.

EXAMPLES

The toner scattering or the like was evaluated, by changing the respective dimensions of the layer thickness adjustment member 14 and the magnetic seal member 20 using the developing apparatus based on the configuration illustrated in FIG. 1.

As the material of the layer thickness adjustment member 14, a non-magnetic material made of austenitic stainless steel of SUS304 was used. The length of the layer thickness adjustment member 14 is 330 mm, and the width is 10 mm. The rectangular notch 14*a* was provided at a position facing the surface of the developing sleeve 17 corresponding to the image non-forming portion of the photoreceptor 3 so that the long side of the rectangle opens toward the developing sleeve 17. The length of the long side of the notch 14*a* is 5 mm.

SUS430 was used as the material of the magnetic seal member 20. Similarly to the notch 14*a*, the magnetic seal member 20 was provided at a position facing the surface of the developing sleeve 17 corresponding to the image non-forming portion of the photoreceptor 3. The length of the magnetic seal member 20 along the axial direction of the developing sleeve 17 is 5 mm.

The amount of conveyance of the developer of the developing roller 13 was 35 mg/cm$^2$. The rotational speed of the developing sleeve 17 was set to 300 rpm, and the rotational speed of the photoreceptor 3 was set to 120 rpm.

The interval between the surface of the developing sleeve 17 and one end portion in the width direction of the layer thickness adjustment member 14 was set to A (mm), the length in the width direction of the notch 14*a* was set to B (mm), the interval between the surface of the developing sleeve 17 and the magnetic seal member 20 was set to C (mm), and these dimensions A, B, and C were changed as illustrated in Table 1. (A+B)/A and C/(A+B) were calculated based on A, B, and C, respectively.

The toner scattering in the vicinity of two end portions of the developing roller was evaluated.

Under an environment of each of temperature of 25° C. and humidity of 5%, the scattered state was visually evaluated in the vicinity of two end portions of the developing roller after performing the print output of 10,000 images having a printing area of 25%, and at an amount of toner consumption before and after printing (reference value×1.1 times or less: ○, less than reference value×1.1 times and reference value×1.2 times or less: Δ, more than reference value×1.2 times or more: x), the overall determination was performed.

An occurrence of fog when printing an image was evaluated.

Under an environment of each of temperature of 25° C. and humidity of 5%, when performing the printing output of 10,000 images having the print area of 25%, the fog values of two end portions were measured every 1,000 images. The method of measuring the fog values was calculated by the following procedure as the density of the non-image portion (image density 0%) of the printed recording sheet. Whiteness $W_1$ of the recording sheet before printing and whiteness $W_2$ in the non-image portion of the recording sheet after printing were measured using a whiteness meter (Z-Σ90 COLOR MEASURING SYSTEM: manufactured by Nippon Denshoku Industries Co., Ltd.), and a difference in whiteness between them ($W_1$-$W_2$) was set to the fog value.

The fog value of 1.0 or less was indicated by ○, the fog value of 1.5 or less was indicated by Δ, and the fog value of more than 1.5 was indicated by x, the fog value of every 1,000 images was generally evaluated.

The developer accumulation in the vicinity of the magnetic seal member 20 was evaluated.

Under an environment of each of temperature of 25° C. and humidity of 5%, when performing the printing output of 10,000 images having the print area of 25%, the states of the carrier adhesion to the recording sheet every 1,000 images and the developer accumulation of the developing apparatus were visually evaluated. A case where the carrier adheres to the recording sheet was indicated by x, a state in which there is no carrier adhesion but the developer does not return to the developing apparatus near the magnetic seal member 20 of the developing apparatus (an overflowing state) was indicated by Δ, and a case where there is neither carrier adhesion nor accumulation of the developer was indicated by ○.

TABLE 1

| | A (mm) | B (mm) | C (mm) | (A + B)/A | C/(A + B) | Evaluation 1 | Evaluation 2 | Evaluation 3 |
|---|---|---|---|---|---|---|---|---|
| Examination case 1 | 0.5 | 0 | 1.7 | 1.0 | 3.4 | X | ○ | ○ |
| Examination case 2 | 0.5 | 0 | 1.5 | 1.0 | 3.0 | Δ | ○ | ○ |
| Examination case 3 | 0.5 | 0.05 | 1.5 | 1.1 | 2.7 | ○ | ○ | ○ |

TABLE 1-continued

| | A (mm) | B (mm) | C (mm) | (A + B)/A | C/(A + B) | Evaluation 1 | Evaluation 2 | Evaluation 3 |
|---|---|---|---|---|---|---|---|---|
| Examination case 4 | 0.5 | 0.15 | 1.5 | 1.3 | 2.3 | ○ | ○ | ○ |
| Examination case 5 | 0.5 | 0.2 | 1.5 | 1.4 | 2.1 | ○ | ○ | ○ |
| Examination case 6 | 0.5 | 0.25 | 1.5 | 1.5 | 2.0 | ○ | X | ○ |
| Examination case 7 | 0.5 | 0.15 | 0.5 | 1.3 | 0.8 | ○ | ○ | ○ |
| Examination case 8 | 0.5 | 0.2 | 0.4 | 1.4 | 0.6 | ○ | ○ | X |
| Examination case 9 | 0.5 | 0.25 | 0.4 | 1.5 | 0.5 | ○ | X | X |
| Examination case 10 | 1.0 | 0 | 2.5 | 1.0 | 2.5 | X | ○ | ○ |
| Examination case 11 | 1.0 | 0 | 2.2 | 1.0 | 2.2 | Δ | ○ | ○ |
| Examination case 12 | 1.0 | 0.05 | 2 | 1.1 | 1.9 | ○ | ○ | ○ |
| Examination case 13 | 1.0 | 0.3 | 2 | 1.3 | 1.5 | ○ | ○ | ○ |
| Examination case 14 | 1.0 | 0.4 | 2 | 1.4 | 1.4 | ○ | ○ | ○ |
| Examination case 15 | 1.0 | 0.5 | 2 | 1.5 | 1.3 | ○ | X | ○ |
| Examination case 16 | 1.0 | 0.4 | 0.8 | 1.4 | 0.6 | ○ | ○ | Δ |
| Examination case 17 | 1.0 | 0.4 | 0.8 | 1.4 | 0.6 | ○ | ○ | X |
| Examination case 18 | 1.0 | 0.5 | 0.8 | 1.5 | 0.5 | ○ | X | X |
| Examination case 19 | 2.0 | 0 | 3.5 | 1.0 | 1.8 | X | ○ | ○ |
| Examination case 20 | 2.0 | 0 | 3 | 1.0 | 1.5 | Δ | ○ | ○ |
| Examination case 21 | 2.0 | 0.8 | 2 | 1.4 | 0.7 | ○ | ○ | ○ |
| Examination case 22 | 2.0 | 1.2 | 2 | 1.6 | 0.6 | ○ | X | X |
| Examination case 23 | 2.0 | 0.6 | 1.5 | 1.3 | 0.6 | ○ | ○ | X |
| Examination case 24 | 2.0 | 0.8 | 1.5 | 1.4 | 0.5 | ○ | ○ | X |
| Examination case 25 | 2.0 | 1 | 1.5 | 1.5 | 0.5 | ○ | ○ | X |
| Examination case 26 | 2.0 | 1.2 | 1.5 | 1.6 | 0.5 | ○ | ○ | X |

Examination cases 3 to 5, 7, 12 to 14, and 21 as evaluation results in which all evaluations 1 to 3 are "○" are Examples 1 to 8 of the present invention. Other examination cases are comparative examples of the present invention.

In the examination cases 1, 2, 10, 11, 19, and 20, since the value of B is 0 mm, that is, the notch is not provided, the toner scattering has occurred.

In the examination cases 6, 9, 15, 18, and 22, since (A+B)/A becomes 1.5 or more, since the depth of the notch is too deep, the fog has occurred. In the examination cases 3 to 5, 7, 12 to 14, and 21, since (A+B)/A is 1.4 or less, it was possible to prevent an occurrence of fog.

In the examination cases 8, 9, 16 to 18, and 22 to 26, although C/(A+B) is 0.6 or less, and the amount of developer is locally increased by providing the notch 14*a*, since the gap between the magnetic seal member 20 and the developing sleeve 17 is too small, the developer accumulation has occurred in the vicinity of the magnetic seal member 20. In the examination cases 3 to 5, 7, 12 to 14, and 21, since C/(A+B) is 0.7 or more, it was possible to prevent an occurrence of the developer accumulation.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A developing apparatus comprising:

a developing roller including a cylindrical sleeve pivotally supported in a freely rotatable manner and a magnet roller equipped with a plurality of magnetic poles fixedly disposed in the sleeve, and configured to carry a two-component developer containing a toner and a carrier on a surface of the sleeve and to convey the developer to a developing region facing a photoreceptor including an electrostatic latent image;

a supply roller configured to supply the two-component developer to the surface of the sleeve on an upstream side in a rotational direction of the sleeve from the developing region;

a layer thickness adjustment member configured to regulate a layer thickness of the two-component developer carried on the surface of the sleeve, the layer thickness adjustment member including a band-shaped member that extends parallel to or substantially parallel to a rotational axis of the sleeve and over a length equal to or substantially equal to an axial length of the sleeve, one end portion thereof in a width direction being disposed to face the surface of the sleeve at an interval, and a notch open to one end portion side in the width direction being provided at two end portions in a longitudinal direction; and a magnetic seal member made of a magnetic material which is spaced away from and provided opposite to the layer thickness adjustment member with the developing roller provided therebetween.

2. The developing apparatus according to claim 1, wherein the notch is provided at a position corresponding to a surface portion of the sleeve that faces a non-image forming portion of the photoreceptor in which an electrostatic latent image is not formed.

3. The developing apparatus according to claim 2, wherein the magnetic seal member faces the surface portion of the sleeve at an interval.

4. An image forming apparatus comprising the developing apparatus according to claim 1.

5. A developing apparatus, comprising:

a developing roller including a cylindrical sleeve pivotally supported in a freely rotatable manner and a magnet roller equipped with a plurality of magnetic poles fixedly disposed in the sleeve, and configured to carry a two-component developer containing a toner and a carrier on a surface of the sleeve and to convey the developer to a developing region facing a photoreceptor including an electrostatic latent image;

a supply roller configured to supply the two-component developer to the surface of the sleeve on an upstream side in a rotational direction of the sleeve from the developing region; and a layer thickness adjustment member configured to regulate a layer thickness of the two-component developer carried on the surface of the sleeve, the layer thickness adjustment member including a band-shaped member that extends parallel to or substantially parallel to a rotational axis of the sleeve and over a length equal to or substantially equal to an axial length of the sleeve, one end portion thereof in a width direction being disposed to face the surface of the sleeve at an interval, and a notch open to one end portion side in the width direction being provided at two end portions in a longitudinal direction; wherein the notch is provided at a position corresponding to a surface portion of the sleeve that faces a non-image forming portion of the photoreceptor in which an electrostatic latent image is not formed;

the developing apparatus further comprises a magnetic seal member made of a magnetic material that faces the surface portion of the sleeve at an interval; and when an interval between the surface of the sleeve and the one end portion in the width direction of the layer thickness adjustment member is set to A (mm), a length in the width direction of the notch is set to B (mm), and an interval between the surface of the sleeve and the magnetic seal member is set to C (mm), relationships of $(A+B)/A \leq$ about 1.4 and $C/(A+B) \geq$ about 0.7 are satisfied.

* * * * *